United States Patent [19]

Matthews et al.

[11] 4,102,148

[45] Jul. 25, 1978

[54] AIR CONDITIONING APPARATUS AND METHOD OF ASSEMBLING SAME

[75] Inventors: Richard E. Matthews, E. Syracuse; Theodore S. Bolton, Liverpool, both of N.Y.

[73] Assignee: Carrier Corporation, Syracuse, N.Y.

[21] Appl. No.: 793,028

[22] Filed: May 2, 1977

[51] Int. Cl.[2] ..... F25B 45/00; F25D 23/12; F25D 19/00; F25D/17/06

[52] U.S. Cl. ..... 62/77; 62/262; 62/298; 62/429

[58] Field of Search ..... 62/298, 62/77, 262, 429, 427

[56] References Cited

U.S. PATENT DOCUMENTS

| | | | |
|---|---|---|---|
| 2,769,320 | 11/1956 | Kuhlenschmidt et al. | 62/427 |
| 2,891,389 | 6/1959 | Tull | 62/427 |
| 2,939,297 | 6/1960 | Kargen et al. | 62/298 |
| 3,766,749 | 10/1973 | Livesay | 62/298 |
| 3,906,741 | 9/1975 | Terry | 62/429 |

*Primary Examiner*—Lloyd L. King
*Attorney, Agent, or Firm*—J. Raymond Curtin; Robert P. Hayter

[57] ABSTRACT

Apparatus forming a self-contained air conditioning unit which includes parts and subassemblies of a particular configuration that may be united with each other in order to construct the apparatus with a minimum of cost and effort.

23 Claims, 8 Drawing Figures

AIR CONDITIONING APPARATUS AND METHOD OF ASSEMBLING SAME

BACKGROUND OF THE INVENTION

1. Field of the Invention

The present invention relates to air conditioning units containing a partition, a fan scrool and a heat exchanger assembly. More specifically, the present invention relates to a method for assembling a partition, fan scroll and heat exchanger assembly (hereinafter collectively referred to as the components) in an air conditioning unit and the apparatus involved.

2. Description of the Prior Art

Air conditioning units, such as self-contained air conditioning units commonly known as window units contain in addition to a casing and grille section, a partition dividing the unit into an evaporator section containing an evaporator fan, an evaporator fan scroll and an evaporator coil assembly; and a condenser section containing a condenser fan, a condenser fan shroud and a condenser coil assembly. These units are usually mounted in a window opening in a room with the evaporator section communicating with the room air to be conditioned and the condenser section communicating with external air, normally outside air. The evaporator fan draws room air through the evaporator into the evaporator section and subsequently forces the same air back into the room. The condenser fan draws external air into the condenser section and forces the air out of the unit through the condenser. These units utilize a conventional refrigeration circuit in which the refrigerant is expanded in the evaporator, absorbing heat from the room air to be conditioned and in which the refrigerant is cooled in the condenser, discharging heat to the external air. A compressor and an expansion control device are necessary to complete the conventional refrigeration circuit.

The partition serves to divide the air conditioning unit into two separate sections each having its own air flow circuit. A fan scroll further serves to define the air flow path in the evaporator section. The condenser and evaporator assemblies are heat exchangers which either absorb that from or discharge heat to the air and serve as either the condenser or the evaporator in the unit.

Prior methods of assembling the components while very effective included mounting the partition to the base pan with numerous screws and similarly mounting the partition to a tube sheet with multiple screws; mounting a cover plate to the fan scroll with screws, and having the fan scroll mount to the partition by creating numerous openings in the partition and corresponding projections on the fan scroll whereby a projection could be inserted through each opening. Other methods used include attaching the partition to a tube sheet with a brace, attaching the fan scroll to the partition with screws, attaching the fan scroll to the tube sheet with clips and generally other methods of fastening involving the use of numerous clips, fasteners and other like devices. Such methods have involved considerable time and expense in assembling the numerous fastening devices with the components and have generally made the unit less accessible for normal maintenance. For examples of various fastening and assembly methods see U.S. Pat. Nos. Terry (3,906,741), Tull (2,891,389), and Kuhlenshmidt (2,769,320).

SUMMARY OF THE INVENTION

An object of the present invention is to provide structural components formed to enable one to employ a simple method for assembling air conditioner components.

A more specific object of the present invention is to eliminate the use of fastening devices in assembling a partition and fan scroll to a tube sheet in an air conditioner.

A further object of the present invention is to provide apparatus for assembly of the partition and fan scroll to a tube sheet.

A still further object of the present invention is to provide a fast and economical method for assembling air conditioner components.

Another object of the present invention is to provide apparatus in an air conditioner which is readily accessible for maintenance and which does not require the dismantling of fastening devices for removal from the air conditioning unit.

Other objects will be apparent from the description to follow and from the appended claims.

The preceding objects are achieved according to a preferred embodiment of the invention by the provision of a coil assembly including a tube sheet affixed to the base pan of an air conditioning unit. Attached to each end of the tube sheet is an end plate having a flange. A fan scroll is further provided having a body width approximately equal to the distance between the external edges of the two flanges and further having an air guide surface. A partition having a partition body, two resilient partition legs, one attached on either end of the partition body, and two resilient partition arms one attached to the end of each of the partition legs is further provided. Assembly is accomplished by the partition being displaced and stressed until the partition arms engage the fan scroll body holding the partition stationary with respect to the fan scroll with the air guide surface of the fan scroll contacting the body of the partition. Then the partition and fan scroll are together attached to the tube sheet by the partition arms being slidably engaged to the flanges of the tube sheet assembly thereby holding the partition and the scroll affixed to the tube sheet.

DESCRIPTION OF THE PREFERRED EMBODIMENT

Figure 1:
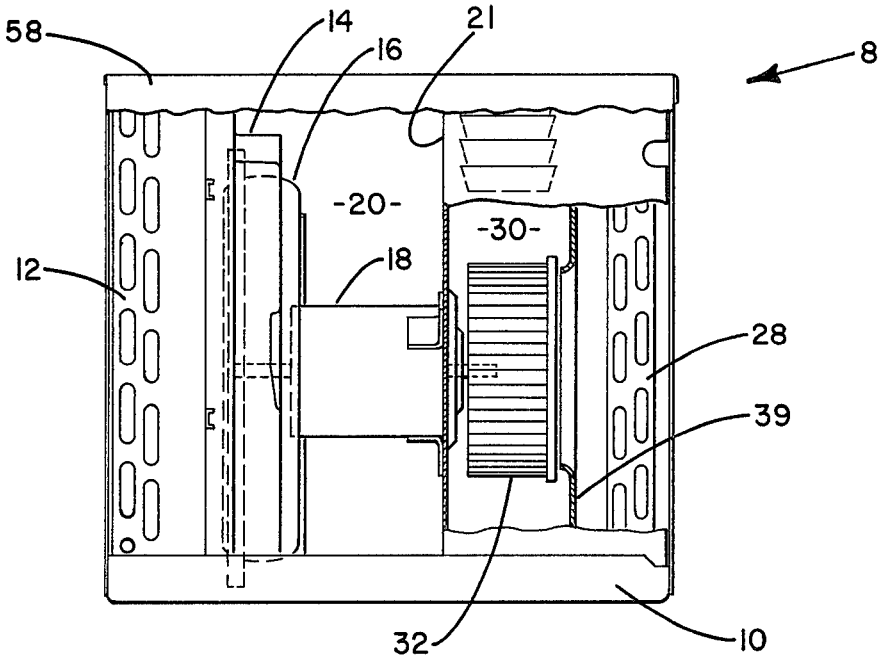
FIG. 1 is a partial schematic view of an air conditioning unit.

Referring now to the drawings, FIG. 1 is a partial schematic view of air conditioning unit 8 being divided into condenser section 20 and evaporator section 30 by partition 21. Condenser section 20 contains condenser coil 12, condenser fan 16, condenser fan shroud 14 and motor 18 connected to evaporator fan 32 and condenser fan 16. Evaporator section 30 contains evaporator coil 28, evaporator fan 32 and evaporator fan scroll 39.

The air conditioning unit 8 is mounted with evaporator section 30 communicating with the room air or the air to be conditioned and with the condenser section 20 communicating with external or outside air. Refrigerant flows in a conventional cycle from the condenser 12 through an expansion control device (not shown), through evaporator 28 into a compressor (not shown) and returns to condenser 12. The refrigerant changes from the liquid state to the gaseous state in evaporator 28 absorbing heat from the air being circulated through evaporator section 30. Evaporator fan 32 draws part of the room air through evaporator 28 where it is cooled and then discharges part of the now conditioned air back into the room. Evaporator fan scroll 39 defines on air path dividing evaporator section 30 into an intake path for air entering the evaporator section through evaporator 28 and an exit path for air to be discharged into the room. The evaporator fan scroll is further designed to maximize the efficiency of evaporator fan 32.

In condenser section 20 the hot compressed refrigerant leaving the compressor is cooled in condenser 12. Condenser fan shroud 14 defines an air flow path enabling condenser fan 16 to draw external air into condenser section 20 and then to discharge the external air through condenser 12 absorbing heat from the refrigerant as the air contacts the condenser surfaces. A motor 18 is mounted in the condenser section and powers both condenser fan 16 and evaporator fan 32.

Figure 2:
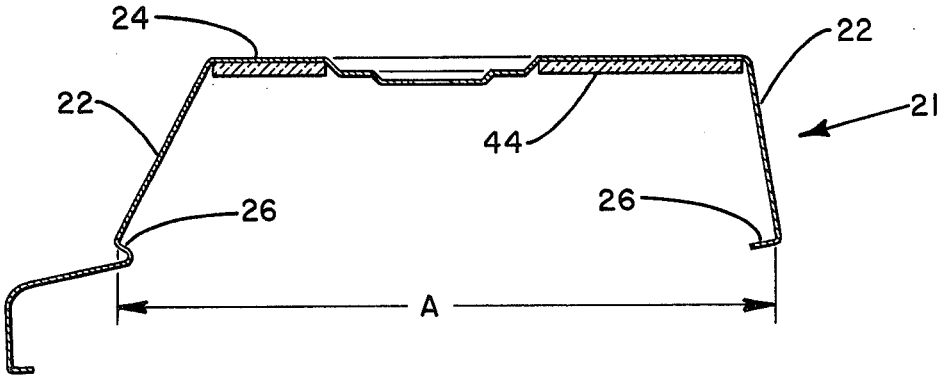
FIG. 2 is a top sectional view of the partition.

FIGS. 2–5 illustrate the various components and the general method at assembly per the claimed apparatus and method. FIG. 2 is a top sectional view of a partition such as partition 21 consisting of partition body 24, partition legs 22, one attached to each end of partition body 24, and partition arms 26, one attached to each end of partition legs 22. Partition body 24, partition legs 22 and partition arms 26 are all constructed of a resilient material, such as sheet steel. The inside of the partition body is covered with a layer of thermal resistent insulation which is also resilient. The partition further serves to divide the air conditioning unit into evaporator section 30 and condenser section 20.

Figure 6:
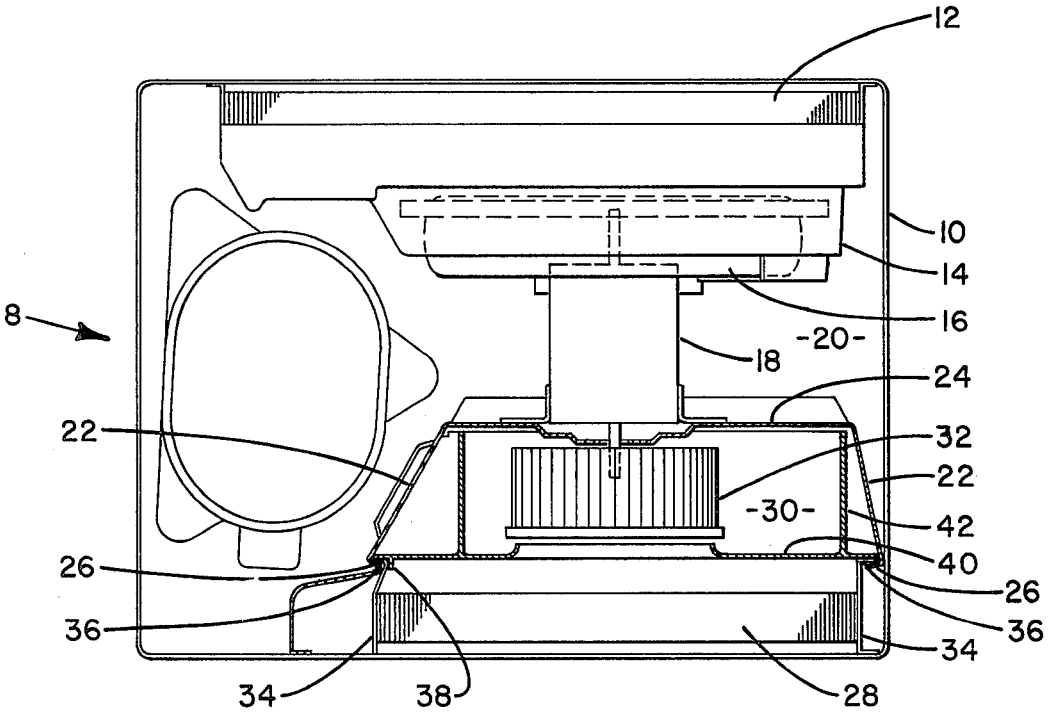
FIG. 6 is a top partial schematic view of an air conditioning unit with the partition, fan scroll and tube sheet shown according to the invention.
Figure 3:
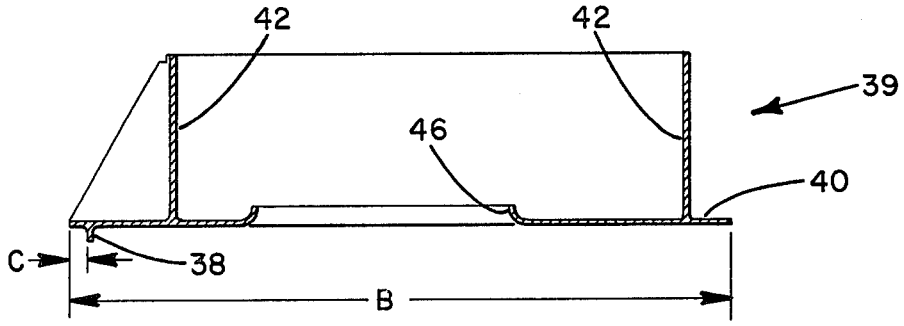
FIG. 3 is a top sectional view of the fan scroll.

Evaporator fan scroll 39 is depicted in FIG. 3 as having a scroll body 40 containing scroll opening 46 for the passage of air into fan 32. Mounted on scroll body 40 perpendicular to the scroll body and generally surrounding scroll opening 46 is a conventional scroll air guide surface 42. Evaporator fan 32 draws air through the evaporator coil 28, through scroll opening 46 and discharges the air in a path determined by scroll air guide surface 42 and partition body 24, see FIGS. 6 and 8.

Figure 4:
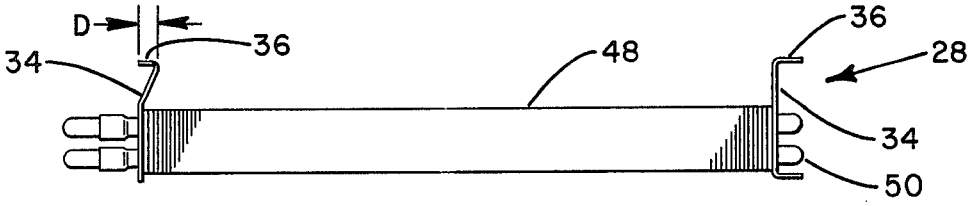
FIG. 4 is a top sectional view of a coil assembly including a tube sheet.

FIG. 4 is a top sectional view of evaporator coil assembly 28. The evaporator coil 48 consists of a myriad of fins through which are mounted tubes carrying the refrigerant. End coils 50 connect the tubes within evaporator coil 48 providing a continuous circuit for the refrigerant through the evaporator coil. Mounted on the ends of evaporator coil 48 are end plates 34 having attached flanges 36 extending outward from the periphery thereof. Evaporator coil assembly 28 is firmly attached to base pan 10 by bolts or like mounting devices.

Figure 5:
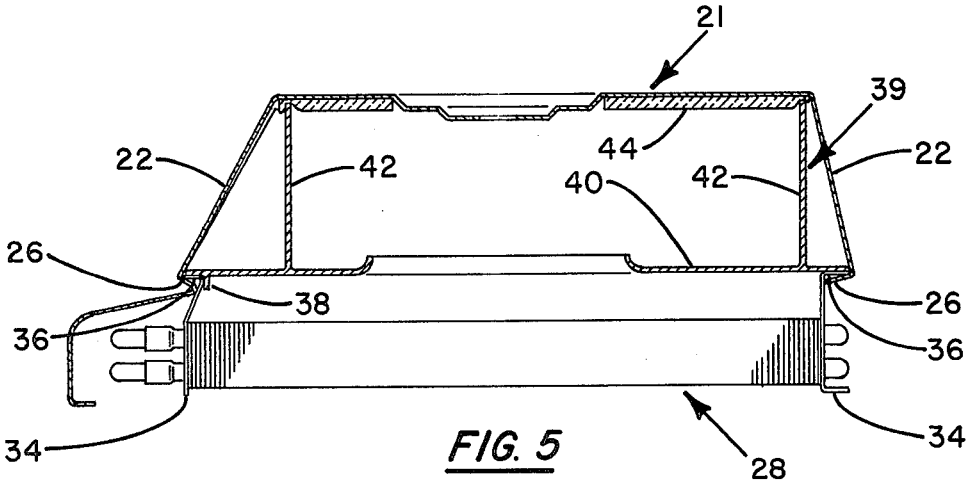
FIG. 5 is a top sectional view of the partition, fan scroll and tube sheet engaged according to the invention.

Partition 21, evaporator fan scroll 39 and evaporator coil assembly 28 are shown in FIG. 5 in their assembled positions. The distance between the junction of partition leg 22 with position arm 26 and the junction of the other position leg 22 with partition arm 26, shown as distance A on FIG. 2, is less than the width of scroll body 40, shown as distance B on FIG. 3. The width of evaporator 28 from the external edge of one flange 36 to the other flange 36 is approximately equal to the width of scroll body 40.

Positioning leg 38 is located on scroll body 40 a distance C (FIG. 3) from the edge of scroll body 40. Flange 36 of evaporator 28 has a width of distance D (FIG. 4) from its internal edge to its external edge. Distance D is greater than distance C so that upon assembly of the components positioning leg 38 engages the inside edge of end plate 34 and flange 36 leaving the outside edge of flange 36 exterior to the outside edge of scroll body 40 at the left edges of evaporator 28 and scroll body 40 as shown in FIG. 5. At the right edges of the scroll body and the evaporator coil assembly on FIG. 5 the edge of scroll body 40 is exterior to the outside edge of flange 36.

Figure 8:
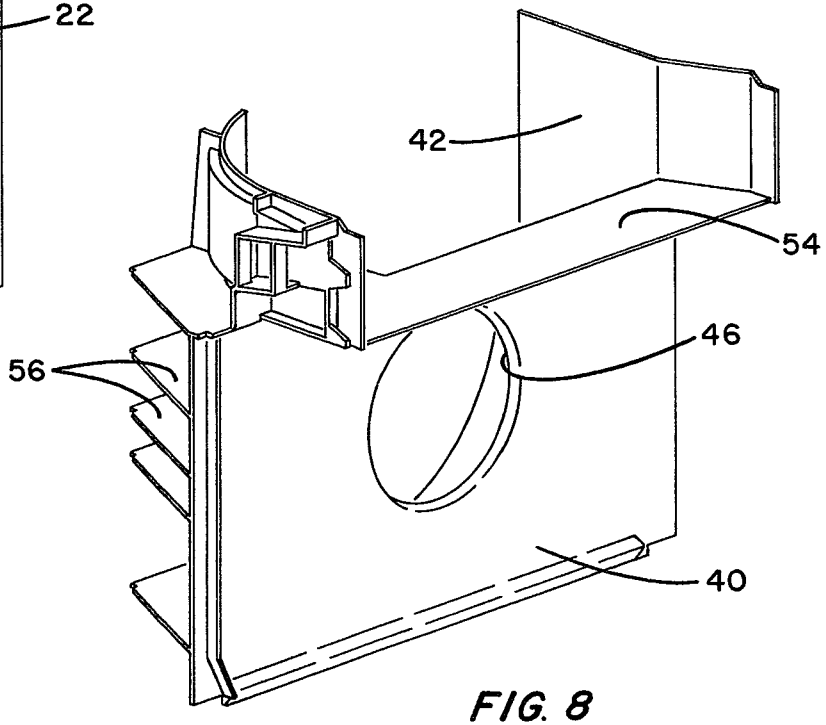
FIG. 8 is a perspective view of the fan scroll.

FIG. 8 is a perspective view of evaporator fan scroll 39. Scroll air guide surface 42 is mounted on scroll body 40. Scroll deck 54 is attached to scroll air guide surface 42 and to scroll body 40. Guide surfaces 56 are inclined surfaces connecting the scroll air guide surface to scroll body 40. Partition 21 is depicted in a perspective view in FIG. 7. Slots 52 are contained within partition arms 26.

Figure 7:
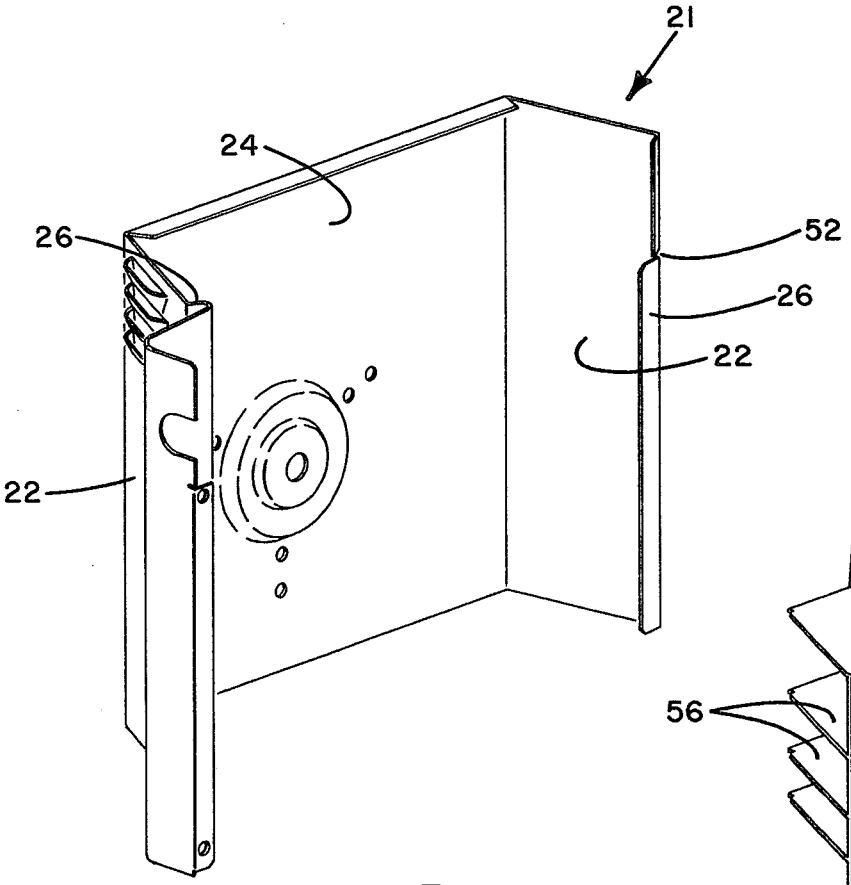
FIG. 7 is a perspective view of the partition.

The components are assembled by first hooking right partition arm 26 as shown in FIG. 7 around the edge of scroll body 40. This hooking is accomplished by partition arm 26 being engaged to one side of scroll body 40 while partition body 24 is on the other side of scroll body 40. Then partition 21 is manually displaced to enable the left partition arm 26 to engage scroll body 40 on the same side of the scroll body as the other partition arm. The partition once placed in position is held in place by the internal stresses created in the resilient material as a result of the displacement. The junction of partition legs 22 and position arms 26 having been separated beyond distance A to distance B, the width of scroll body 40, a force seeking to reduce the distance to distance A is exerted by partition legs 22. This force holds the junctions of partition legs 22 and position arms 26 firmly against the ends of scroll body 40.

Furthermore when partition 21 is engaged to scroll body 40, the scroll air guide surface 42 engages insulation 44 attached to partition body 24. This insulation is resilient and the fit is sufficiently tight to cause a deflection of the insulation at the area of contact. The insulation as a result of the deflection exerts a force against evaporator fan scroll 39 tending to push the evaporator fan scroll away from the insulation. At the same time partition arms 26 engage fan scroll body 40 and exert a force as a result of this displacement tending to push the fan scroll into the insulation. The combination of these two forces firmly holds the evaporator fan scroll preventing movement in the top to bottom direction as shown in FIG. 5. Furthermore the contact and deflection of insulation 44 with the scroll air guide surface 42 forms an air tight seal further defining air circulation within evaporator section 30 of the unit.

As the right partition arm 26 is hooked around the edge of scroll body 40, the edge of scroll deck 54 is inserted into slot 52 in the partition arm 26. As the partition is displaced to engage the other edge of scroll body 40, partition arm 26 may be allowed to slide along guide surfaces 56 being displaced as it proceeds. Inclined guide surfaces 56 terminate at the scroll body edge allowing partition arm 26 to assume the proper position engaging scroll body 40. The insertion of the scroll deck in the slot prevents relative vertical movement between the partition and the evaporator fan scroll.

The partition and the evaporator fan scroll being attached to each other are mounted together onto evaporator 28 which is fixed to base pan 10. The partition and evaporator fan scroll are lifted vertically so that the bottom of the partition and evaporator fan scroll contacts the top of evaporator 28. At this point the partition and evaporator fan scroll are lowered with scroll body 40 contacting flanges 36 and with the right partition leg 26 engaging the side of flange 36 distant from scroll body 40. Simultaneously, the opposite partition leg 26 is displaced to engage the opposite flange 36 on the side of that flange 36 distant from scroll body 40. Simultaneously positioning leg 38 extending from scroll body 40 is placed in position to engage the inside surface of end plate 34 and flange 36, said positioning leg being curved at its extremity to aid in its positioning. Once the partition and evaporator fan scroll are engaged to the evaporator as above the partition and evaporator fan scroll are slid vertically along flanges 36 and end plates 34 to their final position.

Since distance C, from positioning leg 38 to the exterior of scroll body 40, is less than distance D, the width of flange 36, the scroll body is displaced in relation to evaporator 28 notwithstanding their approximately equal width. Referring now to FIG. 5, a force tending to push the evaporator fan scroll to the left holding positioning leg 38 against flange 36 and end plate 34 is created by stressed right partition leg 22 contacting scroll body 40. Partition 21 has a force acting on it tending to the left created by the displacement of left partition leg 22 against left flange 36 and a force acting on it tending to the right created by the displacement of right partition leg 22 against scroll body 40. The combination of the above forces hold partition 21 and evaporator fan scroll 39 stationary relative to evaporator coil assembly 28 in the left-right directions of FIG. 5.

The force asserted as a result of resilient insulation 44 being displaced acts against scroll air guide surface 42 tending to push scroll body 40 against flanges 36 holding evaporator fan scroll 39 in position. Partition feet 26 engaged against the distant side of flanges 36 from scroll body 40 exerts a force holding the partition to evaporator coil assembly 28. Insulation 44 contacting air guide surface 42 exerts a force holding partition arms 26 engaged with flanges 36. The combination of the above forces holds the partition and the evaporator fan scroll in relative position to the evaporator in the top-bottom direction in FIG. 5.

A wrapper 58 (shown cut away in FIG. 1) is attached to the air conditioning unit encasing all the components. Vertical movement of the components is limited by engagement with base pan 10 at the bottom and with the wrapper at the top. Furthermore the wrapper is of the appropriate dimension to form a close fit with the top of partition 21 and with partition legs 22 and partition arms 26 on the sides so that partition 21 forms a relatively air tight division between condenser section 20 and evaporator section 30. The addition of insulation at the appropriate locations on the wrapper can assure a virtually air tight seal.

The force asserted by insulation 44 on scroll air guide surface 42 is sufficient to create an air tight seal between scroll body 40 and flanges 36.

Tight tolerance control on the width of the evaporator coil is extremely difficult during manufacture and variances in length of up to ⅛ inch are common. The above described fastening method has sufficient built-in leeway to provide for fastening within that tolerance.

Once assembled as above it is not necessary to use any screws, clips or other separate devices to hold the partition or evaporator fan scroll in place. However, if desired, a flange can be created on the bottom of either the partition or the evaporator fan scroll so that a screw or other fastening device may be inserted for attaching the part to the base pan.

It is further obvious from the above description that other parts in an air conditioning unit could be assembled in a similar manner such as the condenser fan shroud to the condenser.

From the above description of the preferred embodiment it is clear that a method of assembling a partition, fan scroll and heat exchanger coil assembly without fasteners, clips, screws or other additional parts has been provided according to the objects of the invention.

The invention has been described in detail with particular reference to a preferred embodiment thereof, but it will be understood that variations and modifications can be effected within the spirit and scope of the invention.

We claim:

1. In an air conditioning unit containing a base pan, a condenser fan, an evaporator fan and being divided into an evaporator section and a condenser section improved apparatus for easy assembly said improved apparatus comprising:

a partition for dividing the unit into an evaporator section and a condenser section having a body, two resilient legs one attached to each end of the partition body and two resilient arms extending inward from the ends of the leg sections;

a fan scroll having a scroll body and an air guide surface whereby the arms of the partition may be stressed into a displaced position engaging the scroll body holding the scroll body in place with the air guide surface tight to the partition; and a heat exchanger assembly fixed to the base pan and having attached flanges extending therefrom so that when the arms of the partition are stressed into a displaced position the partition arms engage the flanges whereby the stressed partition holds the partition tightly to the tube sheet flanges and further holds the scroll to the partition and the tube sheet.

2. Improved apparatus as set forth in claim 1 wherein the body section of the partition has resilient insulation affixed thereon whereby the arms of the partition force the air guide surface of the scroll body against the insulation to form an air tight seal between the partition and the fan scroll while holding the scroll body tightly to the tube sheet.

3. Improved apparatus as set forth in claim 1 wherein the unstressed distance between the junction of one partition leg and partition arm, and the junction of the other partition leg and partition arm is less than the width of the scroll body and is less than the distance between the outside edges of the tube sheet flanges.

4. Improved apparatus as set forth in claim 1 and further including a positioning leg attached to the scroll body whereby upon assembly said leg contacts the inside edge of one flange limiting the relative position of the tube sheet and the scroll body.

5. Improved apparatus as set forth in claim 4 wherein the distance from the positioning leg to the outside edge of the scroll body is less than the distance from the inside edge of the flange to the exterior edge of the flange, whereby upon the tube sheet being positioned relative to the scroll body the partition leg and arm closest to the positioning leg engage only the tube sheet flange.

6. Improved apparatus as set forth in claim 5 wherein the width of the scroll body and the distance between the outer edges of the flanges is the same, whereby upon the heat exchanger assembly being positioned relative to the scroll body the partition leg furthest from the positioning leg engages the scroll body stressing the positioning leg against the flange and the partition arm furthest from the position leg contacts the flange holding the scroll between the partition and the heat exchanger assembly.

7. Improved apparatus as set forth in claim 1 wherein the partition arm contains a slot extending from the end of the partition arm towards the junction of the partition arm with the partition leg and the fan scroll has a scroll deck attached to the scroll body allowing the edge of the scroll deck to fit within the slot in the partition arm thereby preventing relative movement between the partition and the scroll.

8. Improved apparatus as set forth in claim 7 and further including guide surfaces extending from an edge of the air guide surface distant from the scroll body to the edge of the scroll body forming an inclined surface to guide the appropriate partition arm and partition leg during assembly around the scroll body to engage the scroll body on the opposite side.

9. The improved apparatus as set forth in claim 1 and further including a wrapper mounted to the base pan surrounding the partition, scroll and heat exchanger assembly preventing vertical movement of same.

10. A method of assembling air conditioning units containing a base pan, an evaporator fan, a condenser fan and being divided into a condenser section and an evaporator section which comprises:

mounting a heat exchanger assembly to a base pan, the assembly having flanges extending therefrom;

constructing a partition having two resilient leg sections, one attached to each end of the partition, and two resilient arm sections extending from the ends of the leg sections;

providing a fan scroll;

affixing the fan scroll to the partition by engaging the resilient partition arms against the fan scroll to create an internal stress within the partition, said internal stress holding the partition to the fan scroll; and sliding the partition arm sections of the now combined fan scroll and partition over the heat exchanger assembly flanges so that the partition is further displaced to create additional internal stresses holding the partition and fan scroll to the heat exchanger assembly.

11. The method as set forth in claim 10 wherein the step of affixing includes:

positioning the fan scroll adjacent to the partition; and displacing the partition arms so that they engage the fan scroll at a displaced position holding the fan scroll to the partition.

12. The method as set forth in claim 10 wherein the step of sliding includes:

locating the combined fan scroll and partition adjacent to the tube sheet; and engaging the partition arms around the tube sheet flanges with the fan scroll contacting the opposite side of the flanges from the partition arms whereby the fan scroll and partition are secured to the tube sheet.

13. The method as set forth in claim 10 wherein the step of providing a fan scroll includes:

attaching to the fan scroll an air guide surface which is perpendicular to the fan scroll whereby upon the step of displacing the partition arms the air guide surface contacts the partition body.

14. The method as set forth in claim 13 and further including:

bonding resilient insulation to the partition body whereby an air tight seal is formed between the partition body and the air guide surface of the fan scroll and the scroll body is forced tightly against the flanges.

15. The method as set forth in claim 10 wherein the step of constructing a partition includes construction in such a manner that the unstressed distance between the junction of one partition leg and partition arm with the other partition leg and partition arm is less than the width of the scroll body and is less than the distance between the outside edges of the heat exchanger flanges.

16. The method as set forth in claim 10 and further comprising:

providing a positioning leg attached to the fan scroll whereby upon sliding said positioning leg contacts the inside edge of one tube sheet flange limiting relative movement of the fan scroll with the tube sheet.

17. The method as set forth in claim 16 wherein the step of providing a positioning leg includes positioning in such a manner that the distance from the positioning leg to the outside edge of the scroll body is less than the distance from the inside of the heat exchanger end plate to the exterior edge of the flange attached to the end plate, whereby upon the air conditioner being assembled the partition leg and arm closest to the positioning leg engage only the heat exchanger flange and do not engage the fan scroll.

18. The method as set forth in claim 17 wherein the steps of providing a positioning leg, mounting a heat exchanger assembly and providing a fan scroll all include the width of the scroll body and the distance between the outer edges of the flanges being the same, whereby upon assembly the partition leg furthest from the positioning leg engages the scroll body stressing the positioning leg against the flange and the partition arm contacts the flange holding the scroll between the partition and the heat exchanger assembly.

19. The method as set forth in claim 10 wherein the step of constructing a partition includes having a partition arm contain a slot extending from the end of the partition arm towards the junction of the partition arm with the partition leg and wherein the step of providing a fan scroll includes a scroll deck being attached to the scroll body whereby upon assembly an edge of the scroll deck fits within the slot in the partition arm preventing relative movement between the partition and the scroll.

20. The method as set forth in claim 19 and further including:

guiding a partition arm around the scroll body edge by constructing a plurality of inclined surfaces extending from the outermost edge of the air guide surface to the edge of the scroll body whereby upon assembly, the partition arm follows the inclined surfaces being displaced and stressed and as the partition arm passes the scroll body edge the internal stress causes it to snap behind the scroll body holding the scroll body to the partition.

21. The method as set forth in claim 10 and further including:

preventing the heat exchanger assembly, partition and scroll body from vertical movement by encasing the tube sheet, partition and scroll body in a wrapper which is fastened directly to the base pan.

22. The method as set forth in claim 19 wherein the step of sliding includes placing into position the pre-assembled fan scroll and partition over the heat exchanger flanges with the partition arms engaging the opposite side of the flanges from the scroll body; said sliding being accomplished by vertical displacement of the partition and fan scroll relative to the heat exchanger with engagement of the ends of the partition and fan scroll with the ends of the heat exchanger flanges thereby resulting in displacement to the assembled position.

23. The method as set forth in claim 21 wherein the step of preventing includes the partition, wrapper and base pan being relatively sized so that the partition forms a tight seal with the wrapper and the base pan thereby dividing the unit into an evaporator section and a condenser section.

* * * * *